US006089669A

United States Patent [19]

Wilcox et al.

[11] Patent Number: 6,089,669

[45] Date of Patent: Jul. 18, 2000

[54] FOLDING OUTDOOR SEAT

[75] Inventors: Jeffrey S. Wilcox; Clifton J. Ratza; Jason E. Begin, all of Grand Rapids, Mich.

[73] Assignee: Attwood Corporation, Lowell, Mich.

[21] Appl. No.: 09/162,578

[22] Filed: Sep. 29, 1998

[51] Int. Cl.[7] ..... A47C 7/02

[52] U.S. Cl. ..... 297/452.65; 297/378.1; 297/DIG. 2

[58] Field of Search ..... 297/452.65, 378.1, 297/DIG. 2, 378.12

[56] References Cited

U.S. PATENT DOCUMENTS

| | | |
|---|---|---|
| D. 183,233 | 7/1958 | Ahrens . |
| D. 227,833 | 7/1973 | Olson . |
| D. 303,878 | 10/1989 | Goldsmith . |
| D. 312,004 | 11/1990 | Smith et al. . |
| D. 333,737 | 3/1993 | Adams . |
| D. 355,779 | 2/1995 | Tribelsky . |
| D. 368,809 | 4/1996 | Fields . |
| 2,193,601 | 3/1940 | Parr . |
| 2,478,529 | 8/1949 | Farr et al. . |
| 2,990,007 | 6/1961 | Kessler . |
| 3,245,717 | 4/1966 | Levy . |
| 3,388,421 | 6/1968 | Koziol . |
| 4,372,609 | 2/1983 | Boisset . |
| 4,521,052 | 6/1985 | Cone . |
| 4,775,187 | 10/1988 | Herr . |
| 4,871,209 | 10/1989 | Handelman . |
| 4,902,070 | 2/1990 | Casale et al. . |
| 4,989,915 | 2/1991 | Hansal . |
| 5,018,788 | 5/1991 | Cedergreen . |
| 5,052,076 | 10/1991 | Spaeth . |
| 5,190,344 | 3/1993 | Anderson et al. . |
| 5,518,296 | 5/1996 | Compardo . |
| 5,658,047 | 8/1997 | Ratza et al. . |

FOREIGN PATENT DOCUMENTS 19076 of 1914 United Kingdom .

*Primary Examiner*—Anthony D. Barfield
*Attorney, Agent, or Firm*—Price, Heneveld, Cooper, DeWitt & Litton

[57] ABSTRACT

A two-piece folding outdoor seat for recreational boats and the like includes a hollow molded seat member and a hollow molded back member. The seat member has an upper surface shaped to abuttingly support a seated user thereon, and a raised rearward portion elevated above the upper surface and shaped to abut the lower back area of the seated user for improved comfort. The raised rearward portion of the seat member includes a plurality of integrally formed hinge fingers extending along an upper portion thereof. The back member has a plurality of integrally formed hinge fingers extending along a lower portion thereof. The hinge fingers on the raised rearward portion of the seat member and the back member are meshed with one another and pivotally interconnected to define a horizontally oriented hinge therealong which permits the back member to be shifted between a lowered storage position and a raised use position.

48 Claims, 7 Drawing Sheets

FOLDING OUTDOOR SEAT

BACKGROUND OF THE INVENTION

The present invention relates to outdoor seating and the like, and in particular to a hollow molded, two-piece folding seat for use in recreational boats, and other similar applications.

Recreation boating has prompted the need for many configurations and styles of boat seating. A particular arrangement which has developed is that of a foldable chair-style seat. This style of seating usually includes a seat portion, a back portion and a hinge disposed therebetween, such that the back portion can be pivoted between a lowered storage position and a raised use position. Quite often, this type of seating arrangement is used in conjunction with a pedestal attachment, thus allowing the user to be elevated well above the deck of the boat.

To be suitable for such outdoor applications, the seat must be sufficiently sturdy to withstand forces acting on the seat, and rigid enough to prevent warping of the seat. Yet the seat should be constructed to be lightweight, and allow for economical manufacturing. In addition, the manufacturing and assembly of prior hinge components of such seating arrangements has typically been rather expensive. In addition, some folding outdoor seats have the hinge exposed, such that the operator may accidentally place their hands within the hinge having them pinched by the abutting surfaces.

Another problem sometimes encountered with current folding outdoor seat designs is that the shape of the seat encourages the collection of water, thus making it necessary for the user to remove the water before using the seat. Also, the rigidity of the hinge connection is often problematic, particularly as pertinent industry standards are raised to improve safety.

SUMMARY OF THE INVENTION

One aspect of the present invention is to provide a two-piece folding outdoor seat for recreational boats and the like, comprising a hollow molded seat member having a plurality of integrally formed fingers extending along a rearward portion thereof. The seat also includes a hollow molded back member having a plurality of integrally formed fingers extending along a lower portion thereof, which are meshed with the hinge fingers of the seat member to define a normally substantially horizontally oriented hinge therealong. A hinge pin extends through the hinge fingers, and pivotally interconnects the seat and back members along the hinge to permit the back member to be shifted between a lowered storage position and a raised use position.

Another aspect of the present invention is to provide a two-piece molded folding outdoor seat for recreational boats and the like, comprising a hollow molded seat member with an upper surface shaped to abuttingly support a seated user thereon, and a raised rearward portion elevated above the upper surface, and shaped to abut the lower back area of a seated user to provide improved comfort and seat rigidity. The raised rearward portion of the seat member includes a plurality of integrally formed hinge fingers extending along an upper portion thereof. The seat also includes a hollow molded back member having a plurality of integrally formed fingers extending along a lower portion thereof. The hinge fingers on the seat member and the back member are meshed with one another, and are pivotally interconnected to define a normally substantially horizontally oriented hinge therealong, which permits the back member to be shifted between a lowered storage position and a raised use position.

Yet another aspect of the present invention is to provide a folding seat, comprising a molded seat member having an upper surface shaped to abutting support a seated user thereon, and a raised rearward portion elevated above the upper surface, and shaped to abut the lower back area of a seated user to provide improved comfort and seat rigidity. The raised rearward portion of the seat includes a stop positioned along an uppermost portion thereof, and a plurality of integrally formed hinge fingers extending below the stop. The seat also includes a molded back member having a plurality of integrally formed hinge fingers extending along a lower portion thereof. The hinge fingers on the seat member and back member are meshed with one another to define a normally substantially horizontally oriented hinge therealong. A hinge pin extends through the hinge fingers, and pivotally interconnects the seat member and the back member along the hinge to permit the back member to be shifted between a lowered storage portion and a raised use position. The hinge pin is positioned a predetermined distance below the stop, such that when the back member is shifted to the raised use position, the back member abuts the stop to assist in transmitting forces which act on the back member to the seat member.

Yet another aspect of the present invention is a method for making a folding seat, comprising the steps of blow molding a seat member with a plurality of integrally formed hinge fingers extending along a rearward portion thereof, and blow molding a back member with a plurality of integrally formed hinge fingers extending along the lower portion thereof. The method further includes meshing the hinge fingers on the seat and back members to define a normally substantially horizontally oriented hinge therealong, and inserting a hinge pin through the meshed hinge fingers to pivotally interconnect the seat member and back member along the hinge to permit the back member to be shifted between a lowered storage position and a raised use position.

The principle objectives of the present invention are to provide a two-piece folding outdoor seat for recreational boats and other similar applications, which is very durable to withstand outdoor applications, and also comfortable during use. Preferably, the folding seat has a hollow molded construction which provides a seat that is both very lightweight, and extremely rigid. Integrally formed hinge fingers which are intermeshed between seat and back portion of the seat provide a very strong pivotal interconnection that is capable of meeting stringent safety standards, and has a long operating life that particularly adapts the same for outside use. Preferably, the seat portion has a raised rear area which is shaped to abut the lower back area of a seated user for improved comfort and increased seat rigidity. Also, a stop may be provided below the hinge to assist in transmitting forces applied to the back member to the seat member. The folding seat also has an uncomplicated design that results in reduced manufacturing and assembling costs, is efficient in use, and is particular well adapted for the proposed use.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
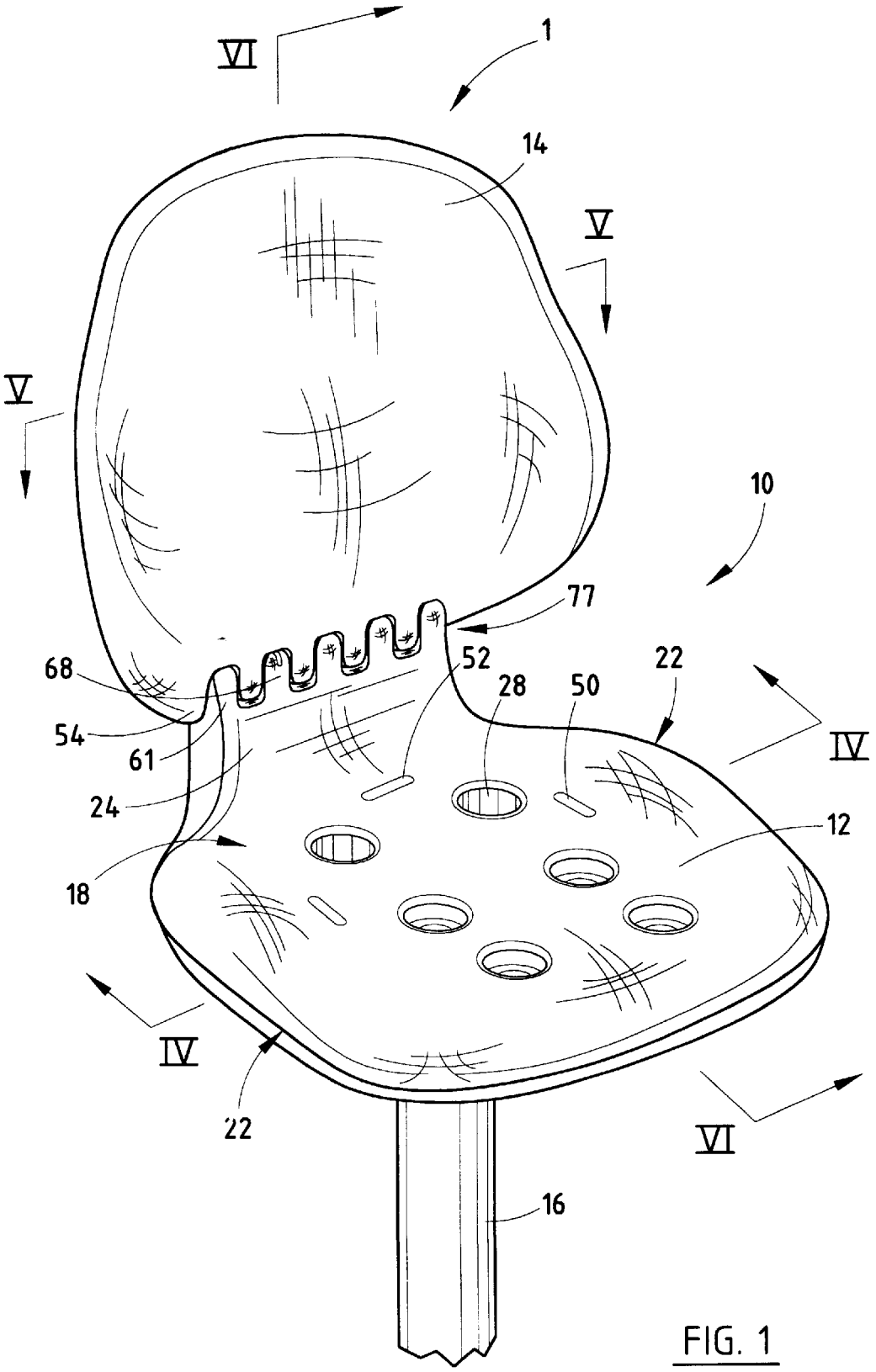
FIG. 1 is a perspective view of a two-piece folding seat embodying the present invention, wherein a back member is shown in a raised use position.

For purposes of description herein, terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 6A:
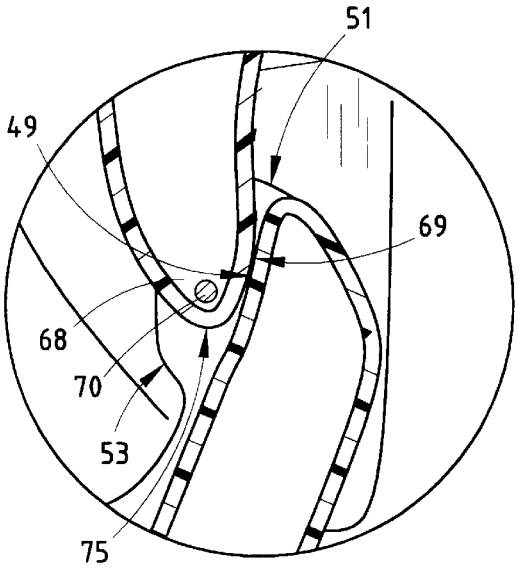
FIG. 6*a* is an enlarged, cross-sectional view of a hinge portion of the seat.
Figure 6:
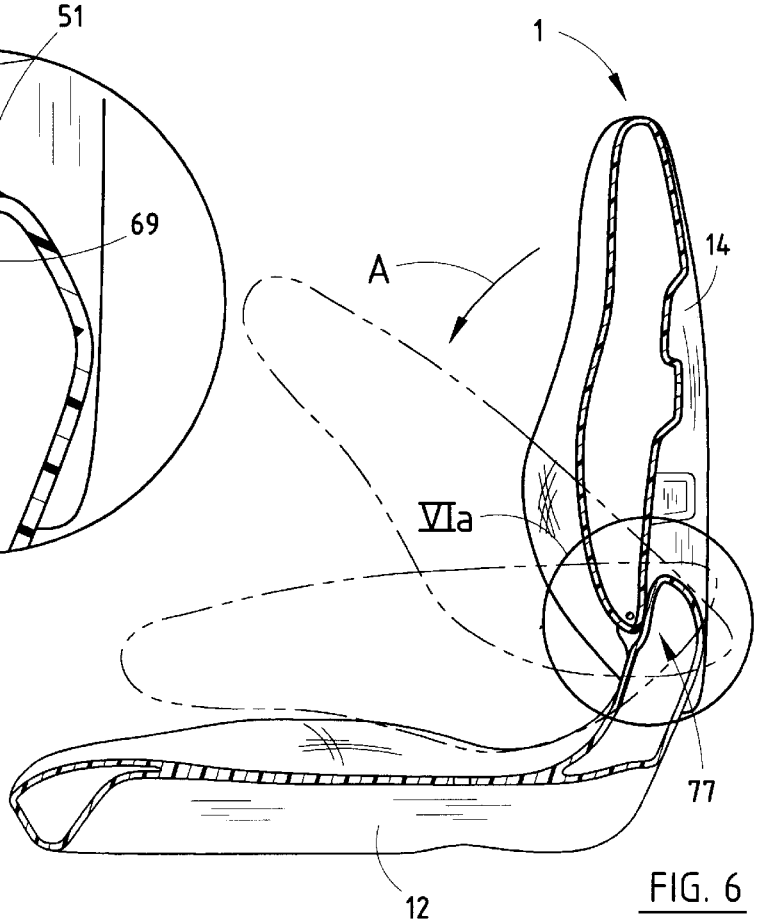
FIG. 6 is a vertical cross-sectional view of the seat, taken along the line VI—VI, FIG. 1, wherein the back member is also shown in an intermediate position and a lowered storage position in broken lines.
Figure 9:
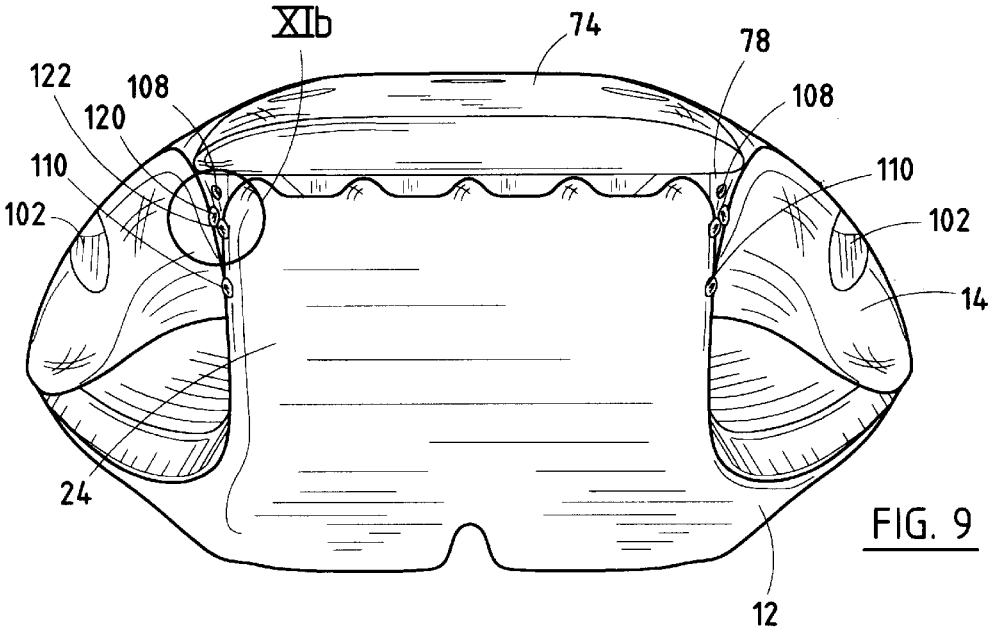
FIG. 9 is a rear elevational view of the seat, wherein the back member is in the lowered storage position.

The reference numeral 1 (FIG. 1) generally designates a two-piece folding outdoor seat embodying the present invention. Seat 1 is particularly adapted for use in recreational boats and other similar applications. Seat 1 includes a hollow molded seat member 12 and a hollow molded back member 14. Seat member 12 has an upper surface 18 shaped to abuttingly support a seated user thereon, and a raised rearward portion 24 elevated above the upper surface 18 and shaped to abut the lower back area of the seated user for improved comfort. The raised rearward portion 24 of seat member 12 includes a first plurality of integrally formed hinge fingers 54 extending along an upper portion thereof. Back member 14 has a second plurality of integrally formed hinge fingers 68 extending along a lower portion thereof. The first and second plurality of hinge fingers 54 and 68 on raised rearward portion 24 of seat member 12 and back member 14 are meshed with one another and pivotally interconnected to define a horizontally oriented hinge 77 therealong which permits the back member 14 to be shifted between a lowered storage position (FIG. 9) and a raised use position (FIG. 6).

The illustrated seat 1 is shown as part of a seat assembly 10 (FIG. 1) that includes seat member 12, back member 14 and a pedestal 16. In the illustrated example, seat member 12 and the back member 14 are constructed from plastic or a material exhibiting similar properties. Seat member 12 and back member 14 are preferably formed through a blow molding process, and have a substantially uniform wall thickness. Although a blow molding process is preferred, it is foreseeable that any suitable method for hollow molding may be utilized.

Figure 4:
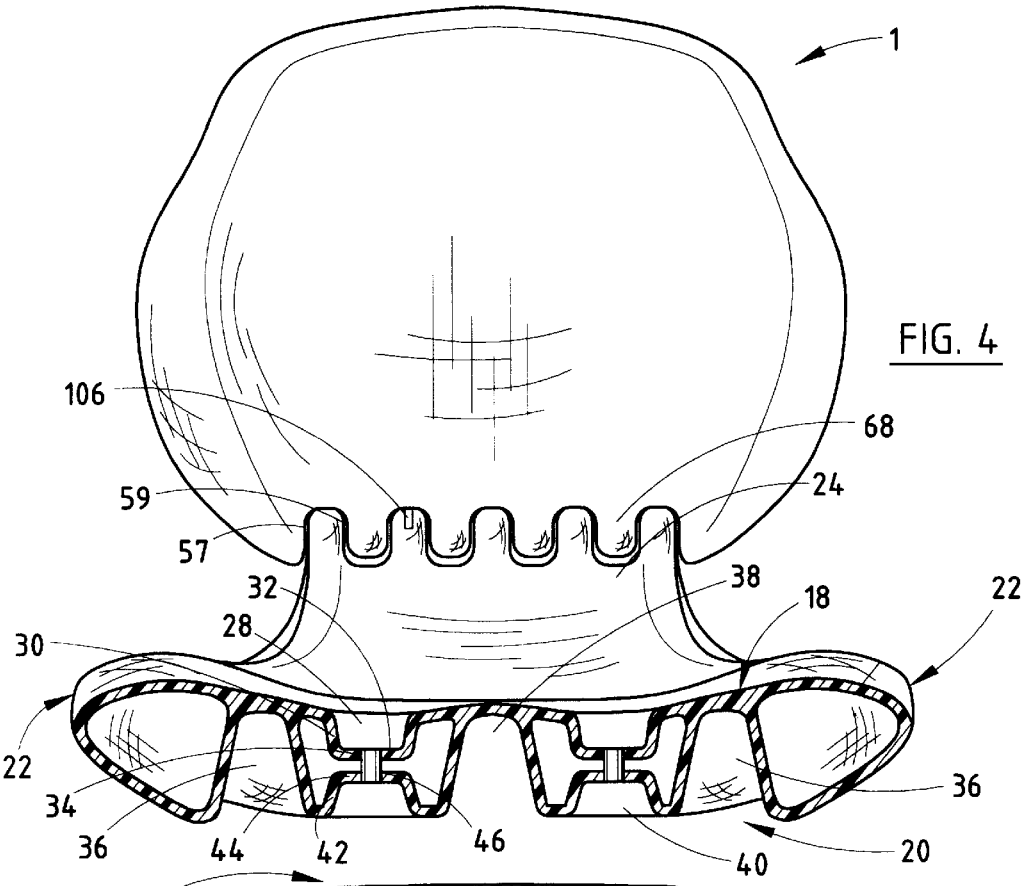
FIG. 4 is a vertical cross-sectional view of the seat, taken along the line IV—IV, FIG. 1.

Seat member 12 (FIGS. 1 and 4) is defined by an upper surface 18, a lower surface 20, rounded side portions 22, and a raised rear portion 24. The upper surface 18 is contoured in a generally concave lateral cross-sectional shape, thus providing increased comfort to the user. The upper surface 18 is further provided with a plurality of upper boss recesses 28, which are substantially cylindrical in configuration. Each upper boss recess 28 is defined by a sidewall 30 and a bottom wall 32. The bottom wall 32 of each upper boss recess 28 is provided with a centrally located aperture 34.

Figure 12:
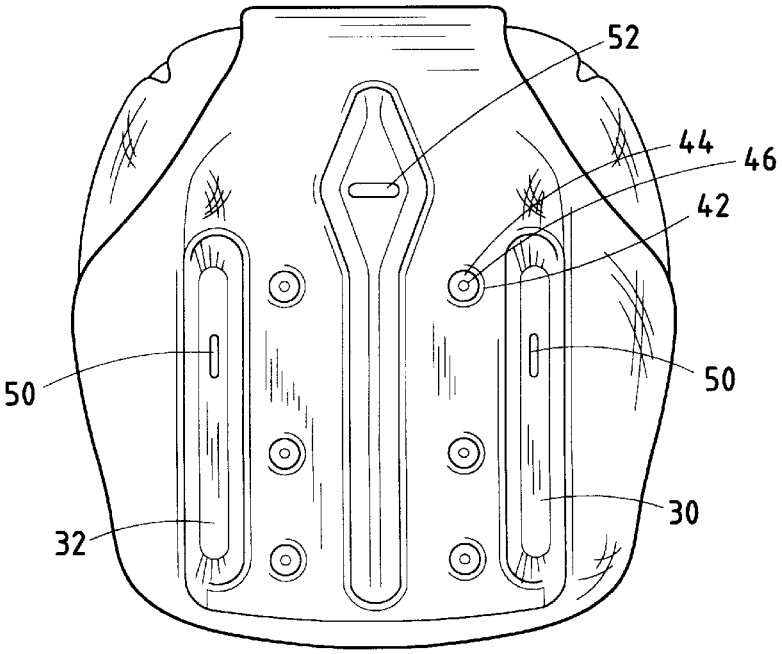
FIG. 12 is a bottom plan view of the seat with the back member shown in the lowered storage position.

The lower surface 20 of seat member 12 (FIGS. 4 and 12) is provided with a pair of U-shaped structural reinforcement side recesses 36 and a U-shaped structural reinforcement center recess 38. The side recesses 36 and the center recess 38 extend a substantial distance along lower surface 28, thus providing the seat member 12 structural rigidity against longitudinal and lateral warping as well as "oil canning." The lower surface 20 is further provided with a plurality of lower boss recesses 40. The lower boss recesses 40 are located within the lower surface 20, such that they are in substantial alignment with the upper boss recesses 28 of the upper surface 18. Each lower boss recess 40 is substantially cylindrical in shape and is defined by a sidewall 42 and an upper wall 44. Each upper wall 44 is provided with a centrally located aperture 46. The aperture 46 of each lower boss recess 40 is in axial alignment with the aperture 34 of each corresponding upper boss recess 28. Threaded mounting nuts 48 are press-fit within each aperture 34 of the upper boss recesses 28 such that the mounting nuts 48 extend between the bottom wall 32 of the upper boss recesses 28 and the upper wall 44 of the lower boss recess 40. The mounting nuts 48 are positioned so as to allow the seat assembly 40 to be secured to an associated mounting structure (not shown), and pedestal 16.

Figure 3:
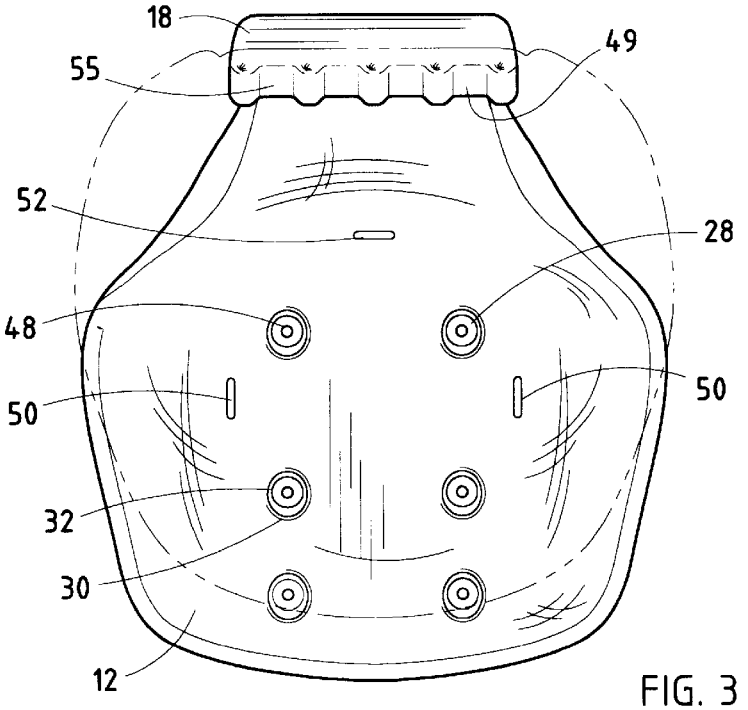
FIG. 3 is a top plan view of a seat member of the seat, wherein the back member is shown in broken lines.

Seat member 12 (FIGS. 1, 3 and 12) is further provided with a pair of side drain holes 50 and a center drain hole 52 extending from the upper surface 18 to side recesses 36 and center recess 38, respectively. The side drain holes 50 and center drain hole 51 are positioned so as to allow water or other liquids which collect on upper surface 18, due to the concavity thereof, to drain through seat member 12.

The rear portion 24 (FIGS. 1, 4, 6 and 6*a*) is integrally molded with the seat member 12 and extends rearwardly and upwardly therefrom. The rear portion 24 is shaped to abut the lower back area of a seated user for improved back support and is contoured in a generally concave lateral cross-sectional shape to provide increased user comfort. By providing support for the lower back area of a seated user, the rear portion 24 helps support the rearward load transmitted by the user onto back member 14, thus increasing the strength of seat 1 to withstand rearward forces.

A first plurality of hinge fingers 54 extends forwardly from rear portion 24. Each hinge finger of the first plurality of hinge fingers 54 is defined by a rounded upper end 51, a rounded lower end 53, a first vertical wall 57 and a second vertical wall 59. The first vertical wall 57 and the second vertical wall 59 are each provided with centrally located apertures (not shown). The apertures (not shown) of the first vertical wall 57 and the second vertical wall 59 of each hinge finger of the first plurality of hinge fingers 54 are in coaxial alignment. The hinge fingers of the first plurality of hinge fingers are positioned side-by-side with a plurality of recesses 55 (FIG. 3) are located therebetween. Each recess 55 is provided with a substantially flat, vertically oriented, forwardly facing surface 49.

Figure 2:
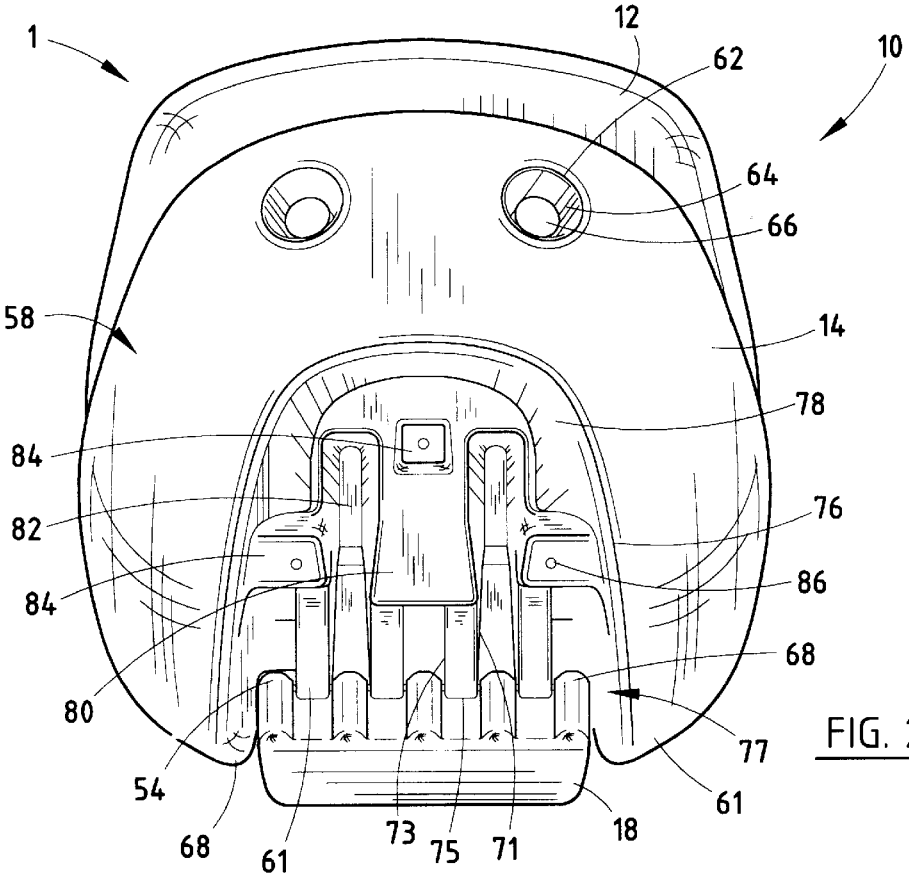
FIG. 2 is a top plan view of the folding seat, wherein the back member is shown in a lowered storage position, and a hinge cover is removed to reveal internal construction.
Figure 5:
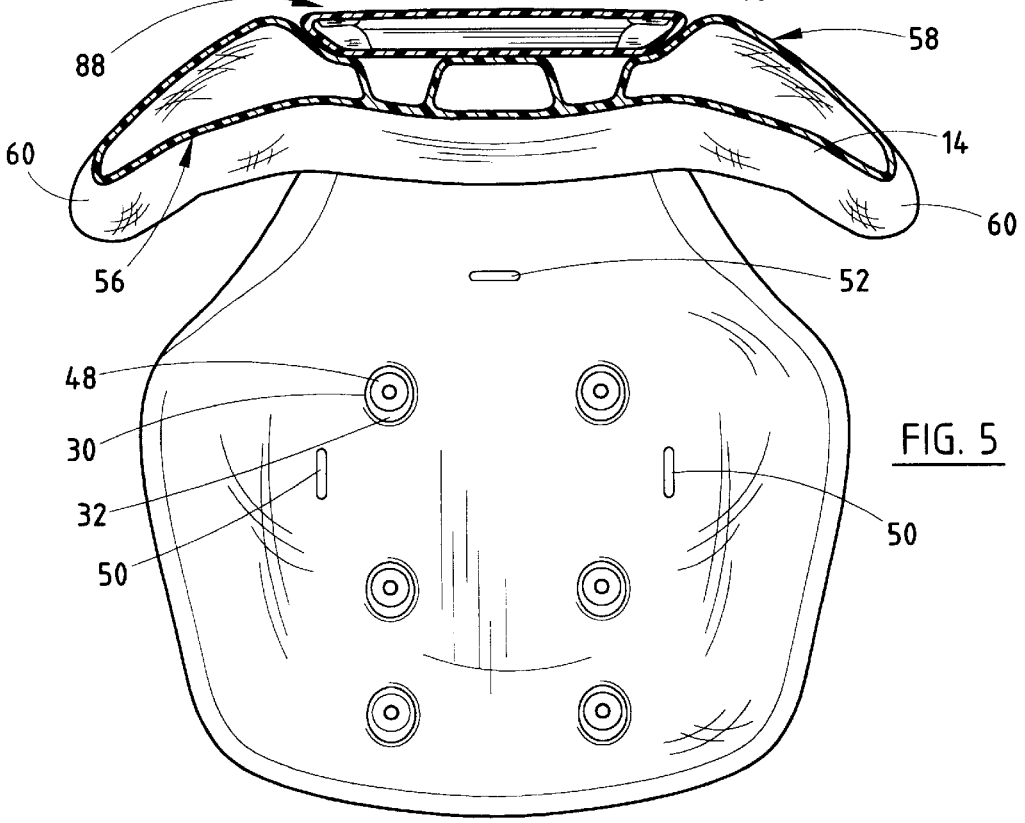
FIG. 5 is a horizontal cross-sectional view of the seat, taken along the line V—V, FIG. 1.

The illustrated back member 14 (FIGS. 1, 2 and 5) is defined by a front surface 56, a rear surface 58, rounded side portions 60 and downwardly extending flanges 61. The front surface 56 is contoured in a generally concave lateral cross-sectional shape to provide increased user comfort. The side portions 60 extend outward and forward from the back member 14 so as to provide the user with increased comfort and back support. The rear surface 58 is provided with structural support recesses 62. The recesses 62 are substantially cylindrical in shape and are each defined by a sidewall 64 and a forward wall 66. The recesses 62 are located so as to provide structural support and prevent longitudinal and lateral warping as well as oil-canning of back member 14.

The back member 14 (FIGS. 2 and 4) is further provided with a downwardly extending second plurality of hinge fingers 68. Each hinge finger of the second plurality of hinge fingers 68 is defined by a first vertical wall 71, a second vertical wall 73, a rounded end 75 and a rearwardly facing surface 69. The first vertical wall 71 and the second vertical wall 73 are each provided with centrally located apertures 70. The apertures 70 of the first vertical wall 71 and the second vertical wall 73 of each hinge finger of the second plurality of hinge fingers 68 are in coaxial alignment. The hinge fingers of the second plurality of hinge fingers 68 are positioned side-by-side with a plurality of raised rearward surfaces (not shown) located therebetween. The raised rearward surfaces add rigidity and strength to the second plurality of hinge fingers 68.

The second plurality of hinge fingers 68 (FIGS. 1, 2, 6 and 6*a*) on back member 14 are configured so as to be mateably engagable with the first plurality of hinge fingers 54 on seat member 12. The present embodiment utilizes five hinge fingers associated with the seat member 12 and four hinge fingers associated with the back member 14, however, other suitable combinations of hinge fingers could be used. In assembly, the apertures (not shown) of each hinge finger of the first plurality of hinge fingers 54 are coaxially aligned with the apertures 70 of each hinge finger of the second plurality of hinge fingers 68 such that a hinge pin 72 may be positioned therein so as to define a horizontally oriented hinge 77 therealong.

In operation, back member 14 is pivoted about hinge pin 72 (FIG. 6) between a lowered storage position to a raised use position. When back member 14 is in the raised use position (FIG. 6*a*) the rearwardly facing surfaces 69 of the second plurality of hinge fingers 68 of back member 14 are in substantial contact with the forwardly facing surfaces 49 of the recesses 55 of seat member 12. Hinge pin 72 is positioned at a predetermined spaced-apart distance below the point where the rearwardly facing surfaces 69 contact the forwardly facing surfaces 49, such that when back member 14 is shifted to the raised use position, the rearwardly facing surfaces 69 contact the forwardly facing surfaces 49, and assist in transmitting rearward forces applied to back member 14 to seat member 12. As compared with previous designs in the art, the multiple contact points inherent in the present invention provide increased strength of the seat 1 to resist rearward forces acting on the back member 14.

The connection of the back member 14 to the raised rear portion 24 of the seat member 12, as opposed to connecting the back member 14 to the seat member 12 without a raised rear portion 24, results in a reduced pivot radius of the back member. The resulting reduced pivot radius allows a reduced storage area for the seat 1 when in a lowered storage position.

After assembly, the seat 1 has a generally overall hourglass-shape. The contoured surfaces of both the seat member 12 and the back member 14, as previously described, afford substantial comfort to the user such that covering the seat 1 with a seat cover or padding is unnecessary.

Figure 7:
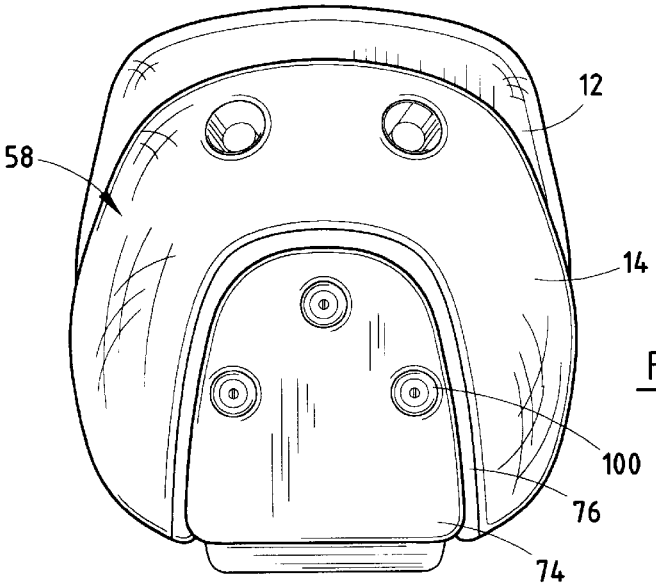
FIG. 7 is a top plan view of the seat, shown with the back member in the lowered storage position, and a hinge cover in place.
Figure 8:
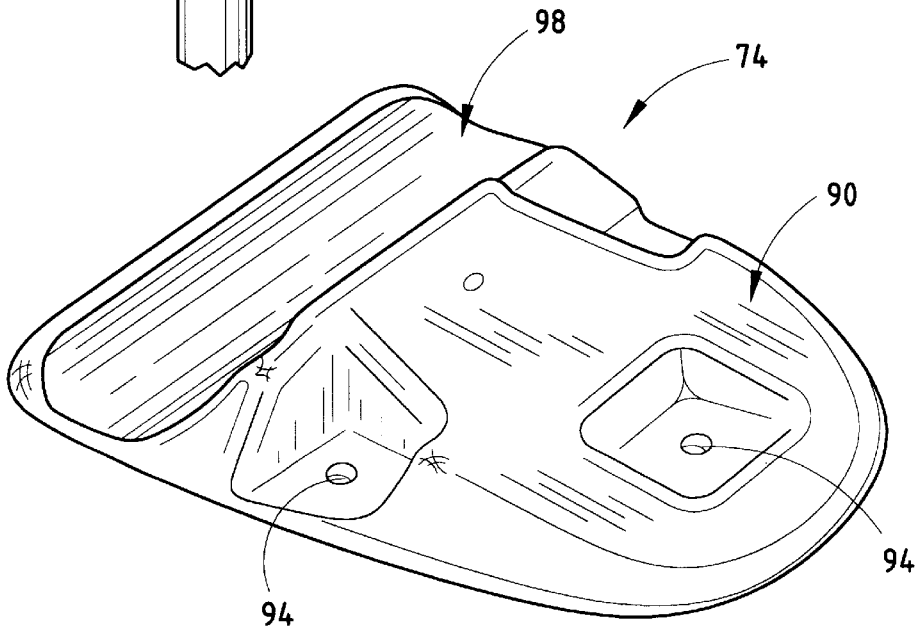
FIG. 8 is a rear, perspective view of the hinge cover.

A hinge cover 74 (FIGS. 7 and 8) is provided to alleviate the possibility of injury to the operator of the chair. More specifically, hinge cover 74 is attached to back member 14 and extends over hinge 77 thus reducing the possibility of the operator being "pinched" between back member 14 and seat member 12 when back member 14 is pivoted between the lowered storage position and the raised in use position.

Back member 14 (FIGS. 2, 5, 7 and 8) is provided with a centrally located D-shaped recess 76. The D-shaped recess 76 is defined by a sidewall 78 and a forward wall 80. Forward wall 80 is provided with structural reinforcement channel-like recesses 82. The channel-like recesses 82 provide increased structural rigidity against longitudinal and lateral warping as well as oil-canning of back member 14. The forward wall 80 is further provided with rearwardly extending raised portions 84. Each raised portion 84 is provided with a centrally located aperture 86.

The hollow molded hinge cover 74 is constructed of plastic or a material exhibiting similar properties. The hinge cover 74 is defined by an outer wall 88 and an inner wall 90. The outer wall 88 is provided with substantially circular mounting recesses 92. The mounting recesses 92 are each provided with a centrally located aperture 94. The inner wall 90 comprises a planar portion 97 and an arcuate portion 98. The planar portion 97 is provided with recesses 96. The recesses 96 are configured and positioned so as to mate with the raised portions 84 of the D-shaped recess 76. The hinge cover 74 is held into position within the D-shaped recess 76 and attached to the back member 14 by way of quick-snap mechanical fasteners 100. The mechanical fasteners 100 are "Christmas tree-type" fasteners, however, any mechanical fastener providing a similar quick-snap connection would be suitable. In assembly, the planar portion 97 of the inner wall 90 of the hinge cover 74 abuts the forward wall 80 of the D-shaped recess 76 of back member 14.

The arcuate portion 98 of the inner wall 90 is configured so as to allow sufficient clearance between the raised portion 24 of the seat member 12 and the inner wall 90 of the hinge cover 74 when the back member 14 is pivoted between the lowered storage and the raised use positions. The hinge cover 74 sits sufficiently recessed within the D-shaped recess 76 such that the outer wall 88 of the hinge cover 74 is substantially flush with the rear surface 58 of the back member 14.

The flanges 61 of back member 14 (FIG. 9) are each provided with hinge pin detents 102. The hinge pin detents 102 are each provided with substantially flat, inwardly facing detent walls 103. Each detent wall 103 is provided with a centrally located hinge pin aperture (not shown) that extends entirely through each flange 61. Each detent wall 103 is provided with an inwardly facing dimple (not shown)

that aids in the alignment of a drilling apparatus during the formation of the hinge pin apertures (not shown). The hinge pin apertures (not shown) of the flanges 61 are coaxially aligned with the apertures (not shown) of the hinge fingers of the first plurality of hinge fingers 54 and the hinge fingers of the second plurality of hinge fingers 68. The hinge 77 between the seat member 12 and the back member 14 is formed by sliding the hinge pin 72 through the hinge pin apertures of one of the flanges 71 until the hinge pin 72 extends through each and every hinge finger of the first plurality of hinge fingers 54 and the second plurality of hinge fingers 68. The diameter of the hinge pin apertures is slightly smaller than the diameter of the hinge pin 72 such that the hinge pin 72 is held in position within the back member 14.

An access window 106 (FIG. 4) is provided within a hinge finger of the first plurality of hinge fingers 54 thus allowing access to the hinge pin 72. Hinge pin 72 is provided with a cylindrically extending groove (not shown). The access window 106 allows access to the hinge pin 72 such that a cotter key (not shown) or similar mechanical fastener may be positioned within the cylindrical groove (not shown) of the hinge pin 72, thus restricting longitudinal movement of the hinge pin 72.

Figure 10:
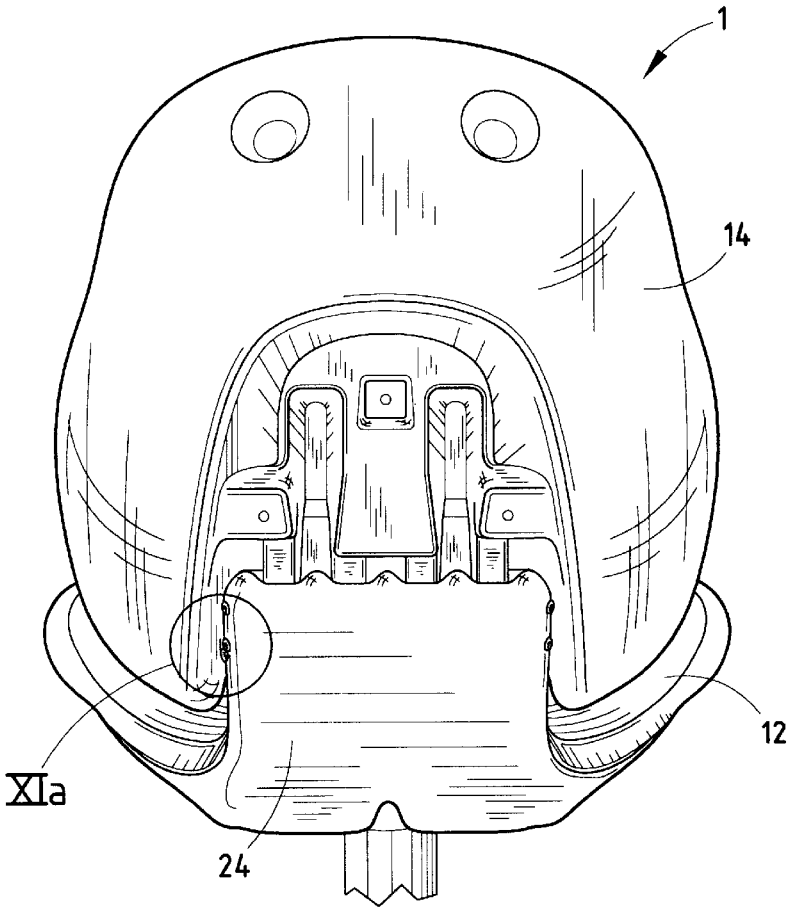
FIG. 10 is a rear elevational view of the seat, wherein the back member is in the raised use position.
Figure 11A:
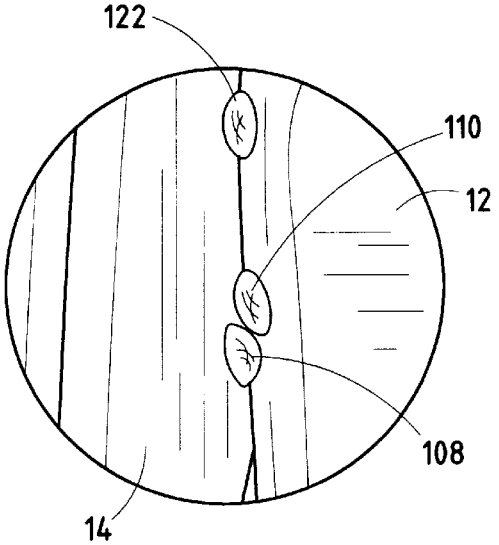
FIG. 11*a* is an enlarged, fragmentary, rear view of the seat showing a raised position back lock portion thereof.

Sidewall 78 (FIGS. 9, 10 and 11*a*) of the D-shaped recess 76 of back member 14 is provided with a first pair of inwardly extending dimples 108. The rear portion 24 of seat member 12 is provided with a first pair of outwardly extending dimples 110. The first pair of inwardly extending dimples 108 and the first pair of outwardly extending dimples 110 are positioned such that substantial contact is generated therebetween when the back member 14 is rotated between the lowered storage and raised use positions. When the back member 14 is in the raised use position, the first pair of inwardly extending dimples 108 are positioned below the first pair of outwardly extending dimples 110 and are in substantial contact therewith, thereby holding the back member 14 in the raised use position and requiring the application of a forward force against the back member 14 to rotate the back member 14 to a lowered storage position.

Figure 11B:
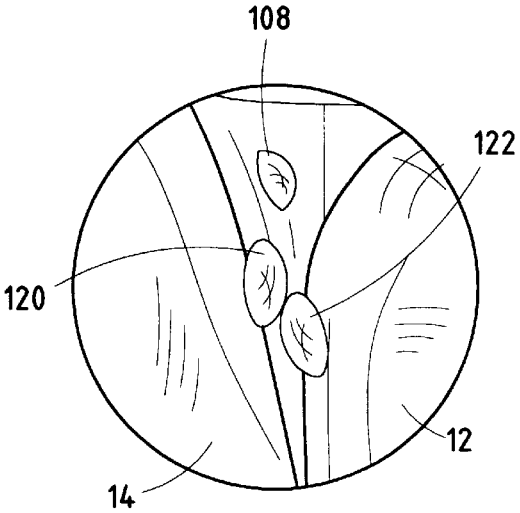
FIG. 11*b* is an enlarged, fragmentary, rear view of the seat showing a lowered position back lock portion thereof.

Sidewall 78 (FIGS. 9, 10, 11*b*) of the D-shaped recess 76 of back member 14 is further provided with a second pair of inwardly extending dimples 120. The rear portion 24 of seat member 12 is further provided with a second pair of outwardly extending dimples 122. The second pair of inwardly extending dimples 120 and the second pair of outwardly extending dimples 122 are positioned such that substantial contact is generated therebetween when the back member 14 is rotated between the lowered storage and raised use positions. When the back member 14 is in the lowered storage position, the second pair of inwardly extending dimples 120 are positioned above the second pair of outwardly extending dimples 122 and are in substantial contact therewith, thereby holding the back member 14 in the lowered storage position and requiring the application of a rearward force against the back member 14 to rotate the back member 14 to a raised use position. The rearward force required to rotate the back member 14 to the raised use position is substantially greater than the force generated by a relative wind while the boat is in a normal mode of operation.

Figure 13:
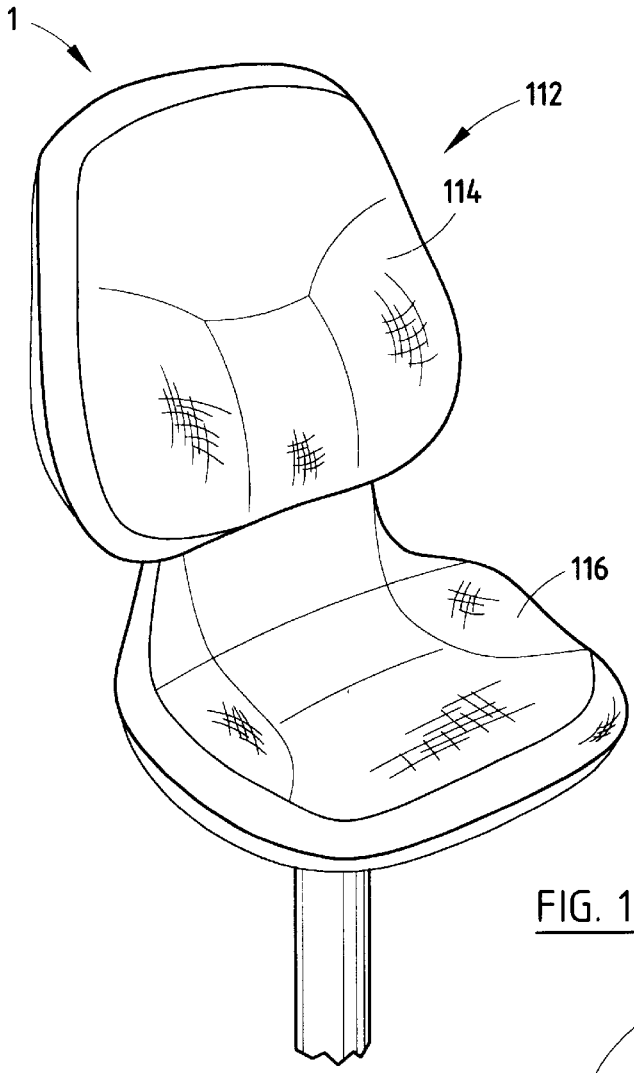
FIG. 13 is a perspective view of the seat, shown with a seat cover.

Referring to FIG. 13, a flexible seat cover 112 is placed over the seat 1 to provide further comfort to the user and increase aesthetic appeal. The seat cover 112 is constructed of cloth, vinyl or other suitable material and is shaped to slip over the seat 1. The seat cover 112 may be constructed as a single piece or may be constructed as a separate upper portion 114 and a lower portion 116 to cover the seat member 12 and the back member 14 separately. The seat cover 112 may be held in place about the seat assembly 10 by those methods common in the art such as providing a draw string, a zipper or J-channel, velcro straps, or by stapling the seat cover 112 directly to the seat 1.

While the foregoing description of the present invention is done within the context of seating for recreational boats, other applications are foreseeable including, but not limited to, earth moving and construction equipment, electric carts, handicap carts and stadium seating.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A two-piece folding outdoor seat for recreational boats and the like, comprising:

a seat member having a hollow body defined by spaced apart upper and lower surfaces with a closed cavity therebetween, and a plurality of generally regularly spaced integrally formed hinge fingers extending along a rearward portion thereof;

a back member having a hollow body defined by spaced apart front and rear surfaces with a closed cavity therebetween, and a plurality of generally regularly spaced integrally formed hinge fingers extending along a lower portion thereof; said hinge fingers on said seat member and said back member being meshed with one another to define a normally substantially horizontally oriented hinge therealong; and a hinge pin extending through each of said hinge fingers, and pivotally interconnecting said seat member and said back member along said hinge to permit said back member to be shifted between a lowered storage position and a raised use position.

2. A folding seat as set forth in claim 1, wherein:

said seat member includes an upper surface shaped to abuttingly support a seated user thereon; and said rearward portion of said seat member is elevated above said upper surface to define a raised rear support which is shaped to abut the lower back area of a seated user for improved comfort, and provides increased seat rigidity.

3. A folding seat as set forth in claim 2, wherein:

said raised rear support includes a stop shaped to engage an adjacent portion of said back member; and said hinge pin is positioned a predetermined spaced apart distance below said stop, such that when said back member is shifted to said raised use position, said back member abuts said stop to assist in transmitting forces applied to said back member to said seat member.

4. A folding seat as set forth in claim 3, including:

a hinge cover connected with one of said seat member and said back member, and extending over said hinge fingers to alleviate exposed pinch areas along said hinge.

5. A folding seat as set forth in claim 4, wherein:

said upper surface of said seat member is contoured in a generally concave lateral cross-sectional shape to provide increased user comfort.

6. A folding seat as set forth in claim 5, wherein:

said back member includes a forward surface shaped to abut the back of a seated user; and said forward surface is contoured in a generally concave lateral cross-sectional shape to provide increased user comfort.

7. A folding seat as set forth in claim 6, wherein:

said seat has a generally hourglass marginal shape to conform to the shape of a seated user.

8. A folding seat as set forth in claim 7, wherein:

said seat member and said back member each have a blow-molded construction.

9. A folding seat as set forth in claim 8, wherein:

said seat member and said back member include engaging retainer portions which engage to facilitate selectively retaining said back member in said raised use position.

10. A folding seat as set forth in claim 9, wherein:

said seat member and said back member include engaging retainer portions which engage to facilitate selectively retaining said back member in said lowered storage position.

11. A folding seat as set forth in claim 10, wherein:

at least one of said seat and back members includes a molded boss which provides a lightweight construction with improved rigidity.

12. A folding seat as set forth in claim 11, including:

a flexible cover shaped to slip over and at least partially envelop one of said seat member and said back member.

13. A folding seat as set forth in claim 12, including:

a support pedestal having an upper end thereof connected with said seat member, and a lower end thereof adapted for mounting in an associated support surface to define a raised pedestal-type seat.

14. A folding seat as set forth in claim 1, including:

a hinge cover connected with one of said seat member and said back member, and extending over said hinge fingers to alleviate exposed pinch areas along said hinge.

15. A folding seat as set forth in claim 1, wherein:

said seat member includes an upper surface thereof contoured in a generally concave lateral cross-sectional shape to provide increased user seat comfort; and said back member includes a forward surface contoured in a generally concave lateral cross-sectional shape to provide increased user back comfort.

16. A folding seat as set forth in claim 1, wherein:

said seat has a generally hourglass marginal shape to conform to the shape of a seated user.

17. A folding seat as set forth in claim 1, wherein:

said seat member and said back member each have a blow-molded construction.

18. A folding seat as set forth in claim 1, wherein:

said seat member and said back member include selectively engaging retainer portions which engage to facilitate retaining said back member in said raised use position.

19. A folding seat as set forth in claim 1, wherein:

said seat member and said back member include selectively engaging retainer portions which engage to facilitate selectively retaining said back member in said lowered storage position.

20. A folding seat as set forth in claim 1, wherein:

at least one of said seat and back members includes a molded boss which provides improved seat rigidity.

21. A folding seat as set forth in claim 1, including:

a flexible cover shaped to slip over and at least partially envelop one of said seat member and said back member.

22. A two-piece folding outdoor seat for recreational boats and the like, comprising:

a seat member having a hollow molded body with an upper surface shaped to abuttingly support a seated user thereon, and a raised rearward portion elevated above said upper surface and shaped to abut the lower back area of the seated user for improved comfort; said raised rearward portion of said seat member including a plurality of integrally formed hinge fingers extending along an upper portion thereof; and a back member having a hollow molded body with a plurality of integrally formed hinge fingers extending along a lower portion thereof; said hinge fingers on the raised rearward portion of said seat member and said back member being meshed with one another and pivotally interconnected to define a normally substantially horizontally oriented hinge therealong, which permits said back member to be shifted between a lowered storage position and a raised use position.

23. A folding seat as set forth in claim 22, wherein:

said raised rearward portion of said seat member includes a stop shaped to engage an adjacent portion of said back member; and said hinge is positioned a predetermined distance below said stop, such that when said back member is shifted to said raised use position, said back member abuts said stop to assist in transmitting forces applied to said back member to said seat member.

24. A folding seat as set forth in claim 23, wherein:

said seat member and said back member each have a hollow, blow-molded construction.

25. A folding seat as set forth in claim 24, including:

a hinge pin extending through said hinge fingers in a normally generally horizontal orientation to pivotally interconnect said seat member and said back member.

26. A folding seat as set forth in claim 25, including:

a hinge cover connected with one of said seat member and said back member, and extending over said hinge fingers to alleviate exposed pinch areas along said hinge.

27. A folding seat as set forth in claim 26, wherein:

said upper surface of said seat member is contoured in a generally concave lateral cross-sectional shape to provide increased user comfort.

28. A folding seat as set forth in claim 27, wherein:

said back member includes a forward surface shaped to abut the back of a seated user; and said forward surface is contoured in a generally concave lateral cross-sectional shape to provide increased user comfort.

29. A folding seat as set forth in claim 28, wherein:

said seat has a generally hourglass marginal shape to conform to the shape of a seated user.

30. A folding seat as set forth in claim 29, wherein:

at least one of said seat and back members includes a molded boss which provides a lightweight construction with improved rigidity.

31. A folding seat as set forth in claim 30, including:

a support pedestal having an upper end thereof connected with said seat member, and a lower end thereof adapted for mounting in an associated support surface to define a raised pedestal-type seat.

32. A folding seat, comprising:

a seat member having a molded body with an upper surface shaped to abuttingly support a seated user thereon, and a raised rearward portion of said seat member elevated above said upper surface and shaped to abut the lower back area of the seated user for improved comfort; said raised rearward portion including a stop positioned along an uppermost portion thereof, and a plurality of integrally formed hinge fingers extending below said stop;

a back member having a molded body with a plurality of integrally formed hinge fingers extending along a lower portion thereof; said hinge fingers on said seat member and said back member being meshed with one another to define a normally substantially horizontally oriented hinge therealong; and a hinge pin extending through said hinge fingers, and pivotally interconnecting said seat member and said back member along said hinge to permit said back member to be shifted between a lowered storage position and a raised use position; said hinge pin being positioned a predetermined distance below said stop, such that when said back member is shifted to said raised use position, said back member abuts said stop to assist in transmitting forces applied to said back member to said seat member.

33. A folding seat as set forth in claim 32, wherein:

said seat member and said back member each have a hollow blow-molded construction.

34. A folding seat as set forth in claim 33, wherein:

said seat member and said back member include selectively engaging retainer portions which engage to facilitate retaining said back member in said raised use position.

35. A folding seat as set forth in claim 34, wherein:

said seat member and said back member include selectively engaging retainer portions which engage to facilitate selectively retaining said back member in said lowered storage position.

36. A folding seat as set forth in claim 35, wherein:

at least one of said seat and back members includes a molded boss which provides improved seat rigidity.

37. A folding seat as set forth in claim 36, wherein:

said seat has a generally hourglass marginal shape to conform to the shape of a seated user.

38. A folding seat as set forth in claim 22, wherein:

said seat member and said back member each have a hollow, blow-molded construction.

39. A folding seat as set forth in claim 22, including:

a hinge pin extending through said hinge fingers in a normally generally horizontal orientation to pivotally interconnect said seat member and said back member.

40. A folding seat as set forth in claim 22, including:

a hinge cover connected with one of said seat member and said back member, and extending over said hinge fingers to alleviate exposed pinch areas along said hinge.

41. A folding seat as set forth in claim 22, wherein:

said upper surface of said seat member is contoured in a generally concave lateral cross-sectional shape to provide increased user comfort.

42. A folding seat as set forth in claim 22, wherein:

said back member includes a forward surface shaped to abut the back of a seated user; and said forward surface is contoured in a generally concave lateral cross-sectional shape to provide increased user comfort.

43. A folding seat as set forth in claim 22, wherein:

said seat has a generally hourglass marginal shape to conform to the shape of a seated user.

44. A folding seat as set forth in claim 22, wherein:

said raised rearward portion at said seat member includes a stop shaped to engage an adjacent portion of said back member; and said hinge is positioned a predetermined spaced apart distance below said stop, such that when said back member is shifted to said raised use position, said back member abuts said stop to assist in transmitting forces applied to said back member to said seat member.

45. A folding seat as set forth in claim 22, wherein:

said seat member and said back member include engaging retainer portions which engage to facilitate selectively retaining said back member in a raised use position.

46. A folding seat as set forth in claim 22, wherein:

said seat member and said back member include engaging retainer portions which engage to facilitate selectively retaining said back member in a lowered storage position.

47. A folding seat as set forth in claim 22, wherein:

at least one of said seat and back members includes a molded boss which provides a lightweight construction with improved rigidity.

48. A folding seat as set forth in claim 22, including:

a flexible cover shaped to slip over and at least partially envelop one of said seat member and said back member.

* * * * *